United States Patent [19]

Amici et al.

[11] Patent Number: 4,585,425

[45] Date of Patent: Apr. 29, 1986

[54] GLOVE PUPPET ASSEMBLY WITH FINGER ACTUATED CLAWS

[75] Inventors: Francis R. Amici, Northford; Hans S. Berger, Plainville; John P. McNett, Farmington, all of Conn.

[73] Assignee: Coleco Industries, Inc., West Hartford, Conn.

[21] Appl. No.: 703,692

[22] Filed: Feb. 21, 1985

[51] Int. Cl.[4] ..... A63H 3/14

[52] U.S. Cl. ..... 446/327; 446/304; 446/365

[58] Field of Search ..... 446/327, 328, 329, 330, 446/337, 338, 339, 352, 353, 359, 304, 358, 365, 368, 26, 301, 298

[56] References Cited

U.S. PATENT DOCUMENTS

| | | | |
|---|---|---|---|
| 683,857 | 10/1901 | Kilpatrick . | |
| 928,744 | 7/1909 | Fisher . | |
| 1,417,860 | 5/1922 | Reich . | |
| 1,432,628 | 10/1922 | Slocum . | |
| 1,518,576 | 12/1924 | Edwards . | |
| 1,773,834 | 8/1930 | Wilson . | |
| 1,782,477 | 11/1930 | Price . | |
| 1,865,305 | 6/1932 | Dallas . | |
| 2,158,860 | 5/1939 | Hyde . | |
| 2,241,576 | 5/1941 | Barton . | |
| 2,491,846 | 12/1949 | Boekenoogen et al. . | |
| 2,614,365 | 10/1952 | Musselwhite et al. . | |
| 2,644,273 | 7/1953 | Romano | 446/338 |
| 2,725,670 | 12/1955 | Hodes . | |
| 2,756,448 | 7/1956 | Werbe . | |
| 3,153,871 | 10/1964 | Semba . | |
| 3,698,127 | 10/1972 | Harp . | |
| 3,835,582 | 9/1974 | Stubbmann | 446/363 |
| 3,918,180 | 11/1975 | Chamberlin . | |
| 3,942,283 | 3/1976 | Rushton . | |
| 4,244,138 | 1/1981 | Holahan et al. . | |
| 4,304,065 | 12/1981 | Baiera . | |
| 4,307,533 | 12/1981 | Sims et al. | 446/365 X |
| 4,324,065 | 4/1982 | Cooper . | |

*Primary Examiner*—Mickey Yu

[57] ABSTRACT

A glove puppet assembly simulating a creature with movable claws has a body member and forwardly extending claw members with lever arm portions which extend into the cavity of the body member. A bell crank assembly in the cavity is pivotally connected to the inner ends of the lever arm portions, and an actuator connected to the bell crank assembly extends outwardly of the body member so that it may be manually actuated to pivot the bell crank assembly and cause the forward ends of the claw members to move relative to each other. A glove is secured to the lower outer surface of the body member and has a finger thereof extending through a ring portion on the actuator so that the user's finger may be pivoted downwardly to provide the desired manual action. The creature also includes a tail member pivoted to the body member, and it is pivotable by relative motion between the forearm and hand of the user in the glove.

20 Claims, 8 Drawing Figures

GLOVE PUPPET ASSEMBLY WITH FINGER ACTUATED CLAWS

BACKGROUND OF THE INVENTION

Over the years, many toys have been fabricated so as to simulate creatures of various types and some of these have employed mechanical elements to simulate the action which might be found in such creatures in real life or in fiction in order to provide enhanced play action. It is also well known to provide glove puppets wherein the hand is inserted into a puppet strucuture with the fingers extending into various portions of the puppet structure so as to effect movement thereof and to simulate movement of the creature simulated by the puppet.

In recent years, there has been increased interest in science fiction, and various toys have been fabricated so as to simulate the appearance of fictional creatures imagined to occur in outer space. Some of these creatures have included articulated elements and others have included motors and other devices to effect relative motion of components of the creature.

It is an object of the present invention to provide a novel, simulated creature having claw-like elements which can be moved relative to each other an which creature may be manipulated readily to provide enhanced play action.

It is also an object to provide such a creature in combination with a glove to form a glove puppet assembly in which the user's fingers may effect facile manipulation of the claw-like elements.

Another object is to provide such a creature in which the individual elements may be fabricated readily and assembled in a facile manner to produce a relatively durable and highly effective play action toy.

SUMMARY OF THE INVENTION

It has now been found that the foregoing and related objects may be readily attained in a simulated creature which includes a body member having top and bottom elements which define a cavity therebetween. A pair of claw elements extend outwardly and forwardly of the body member and have lever portions extending inwardly of its body cavity. In the body cavity is a bell crank assembly which includes a bell crank having a generally vertical leg and a generally horizontal forwardly extending leg at the upper end of the vertical leg. The assembly also includes a bell crank follower having its forward end pivotally connected to the lower end of the vertical leg of the bell crank for pivotal movement relative thereto about a transverse axis. Crank pivot means pivotally mounts the juncture of the legs of the bell crank on the body of the creature for pivotal movement relative thereto about an axis extending transversely of the body member.

The bell crank follower has its rearward end pivotably connected to the inner ends of the lever portions of the claw members for relative pivotal movement about a vertical axis. Lever pivot means pivotally mount the lever portions on the body at points spaced transversely from the pivotal connection to the bell crank follower for pivotal movement of the lever portions about parallel vertical axes. An acutuator means has one end extending outwardly of the body and the other end pivotally connected to the forward end of the horizontal leg of the bell crank. This enables movement of the actuator means downwardly to pivot the horizontal leg of the bell crank downwardly about the crank pivot means from a first position to a second position. The bell crank follower is caused to drive the inner ends of the lever portions of the claw members rearwardly which pivots them about the lever pivot means to move the outer ends of the claw members towards each other, thus providing highly effective simulated claw closing action.

In the preferred embodiment, the acutuator means extends downwardly in the cavity and outwardly through an aperture in the bottom element of the body member, and this outwardly extending portion of the actuator means is adapted to be pulled downwardly manually. Desirably, the actuator means terminates in a ring portion through which a finger may be inserted to effect the downward movement, and the upper end of the actuator means terminates in a yoke portion which receives the forward end of the horizontal leg of the bell crank therebetween. A pivot element extends through aligned apertures in the two elements to provide the pivotal connection therebetween.

Desirably, there is included means biasing the bell crank into its first position, and this biasing means may be a spring operating between the bell crank and the body member. In its preferred aspect, the biasing means is a tension spring having one end attached to the forward end of the horizontal leg of the bell crank and its other end attached to the top element at a point spaced above the bell crank.

The inner ends of the lever portions and the rearward end of the crank follower are disposed in overlying relationship and a pivot member extends through aligned apertures therein to provide the pivotal connection therebetween.

In its preferred aspect, the creature includes a glove adapted to receive a user's hand, and this glove extends along the lower outer surface of the bottom element, and is secured to the bottom element by suitable securing means glove. The actuator means extends downwardly in the cavity and outwardly through an aperture in the bottom element of the body member and has a ring portion thereon which is adapted to be engaged by a user's finger in the glove. In addition, the structure may include a support ring secured to the outer surface of the bottom element rearwardly of the actuator means and through which the one finger of the glove also extends.

In a highly desirable embodiment of the creature of the present invention, there is included a tail member and means pivotally connecting the tail member to the rearward end of the body member for relative pivotal movement about an axis extending transversely of the body member. A user's hand seated in the glove will result in the forearm of the user being disposed below the tail member, and relative movement of the hand and the foremarm will produce pivoting of the tail and body members relative to each other.

DETAILED DESCRIPTION OF THE ILLUSTRATED EMBODIMENT

Figure 1:
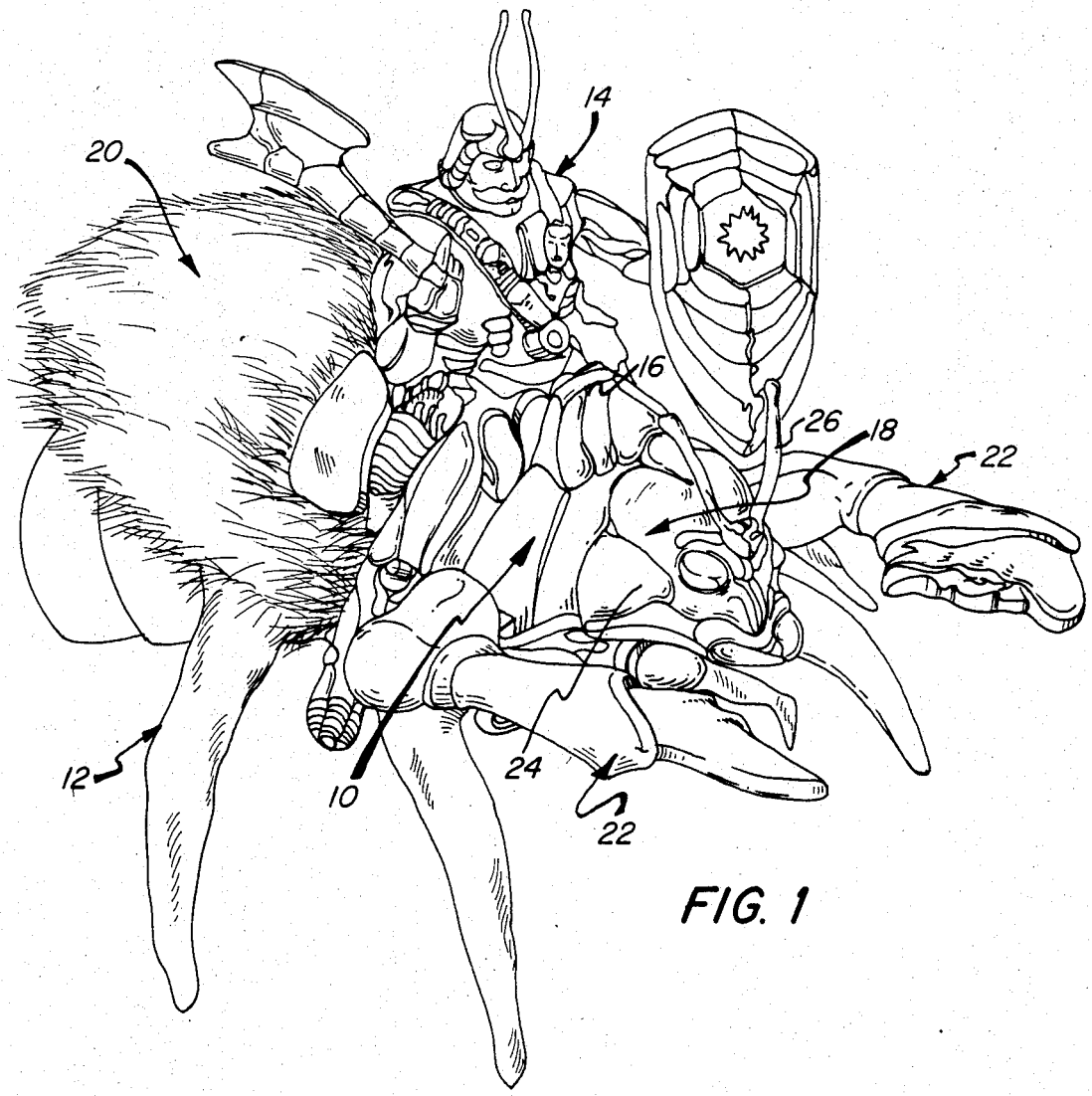
FIG. 1 is a perspective view of a glove puppet creature assembly embodying the present invention with a humanoid figure seated in a saddle thereon.

Turning first to FIG. 1 of the attached drawings therein illustrated is a glove puppet creature assembly having movable claws and embodying the present invention. The molded creature is generally designated by the numeral 10 and has assembled to the bottom surface thereof a glove generally designated by the numeral 12. Seated in a saddle 16 thereon is a humanoid generally designated by the numeral 14. The creature 10 is generally comprised of a body member which is generally designated by the numeral 18, a tail member generally designated by the numeral 20 which is pivoted to the rear end of the body member 18, and a pair of claws generally designated by the numeral 22.

Figures 3, 4, 7:
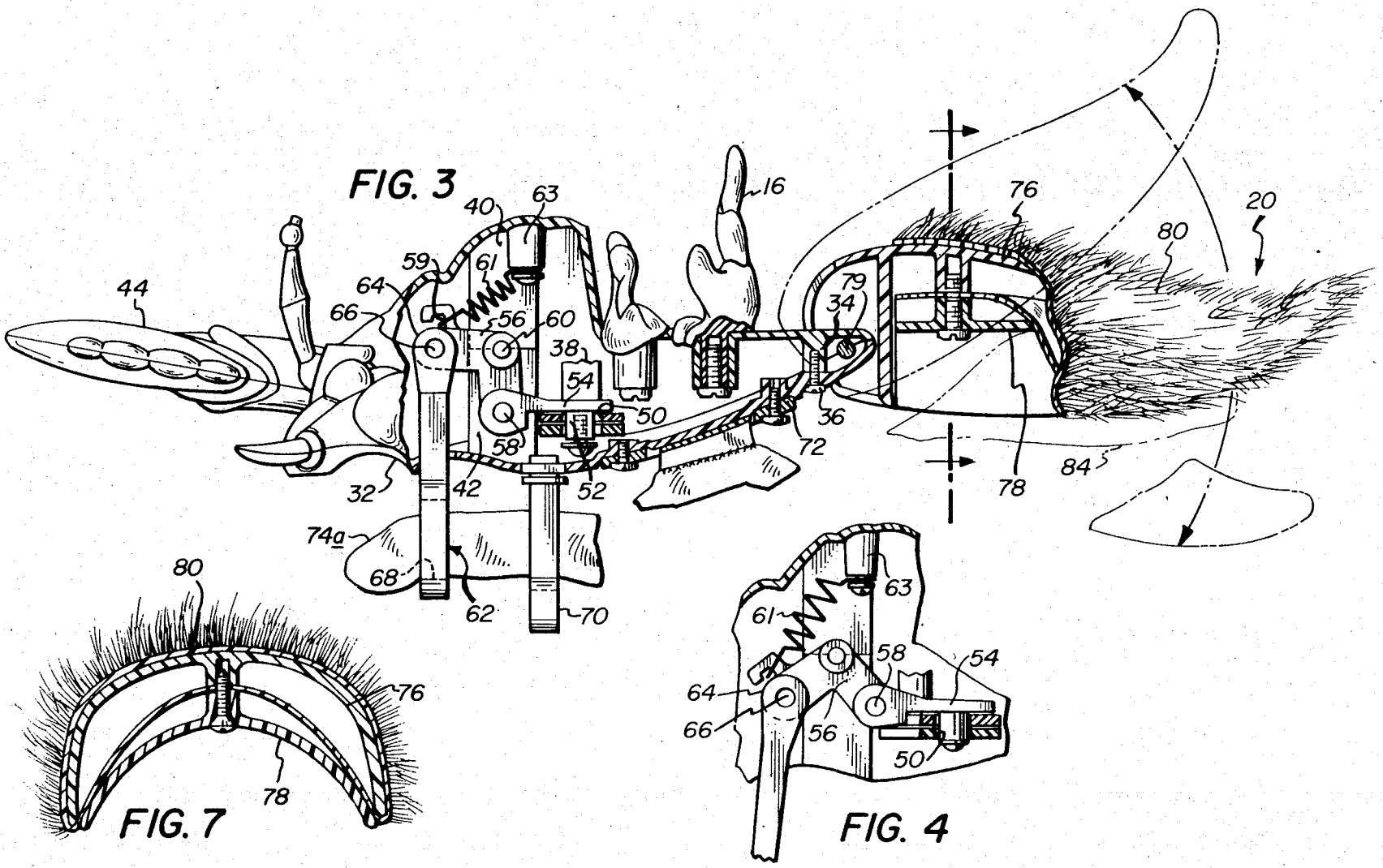
FIG. 3 is a side elevational view of the assembly creature with portions of the several elements broken away to reveal internal construction, with the glove only fragmentarily illustrated a user's finger and forearm shown fragmentarily, and with user's forearm, and the tail member shown pivoted upwardly, in phantom line.
FIG. 4 is a fragmentary view to and enlarged scale of the bell crank assembly pivoted downwardly from the position shown in FIG. 3.
FIG. 7 is a sectional view along the line 7—7 of FIG. 3.

As seen in FIGS. 1 and 3, the body member 18 is configured to provide a head 24 from which extend antennae 26 and torso 28 upon which is mounted the saddle 16 by threaded fasteners. The body memeber 18 is comprised of a top section 30 which provides the bulk of the contours for the torso 28 and head 24, and a bottom section 32 which mates therewith along transversely extending surfaces to define a cavity therebetween. The two sections 30,32 are secured together by screws which extend upwardly through apertures in the bottom sections 32 and threadably engage in depending posts 34 formed in the top section 30.

As seen in FIGS. 3–6, the top section 30 also provides a pair of pivot posts 38 which depend therefrom intermediate its length and a pair of crank pivot posts 40 which are spaced forwardly therefrom and which also depend from the top wall of the top section 30. The bottom section 32 has a pair of upstanding posts 42 which are aligned with the crank pivot posts 40.

Figure 5:
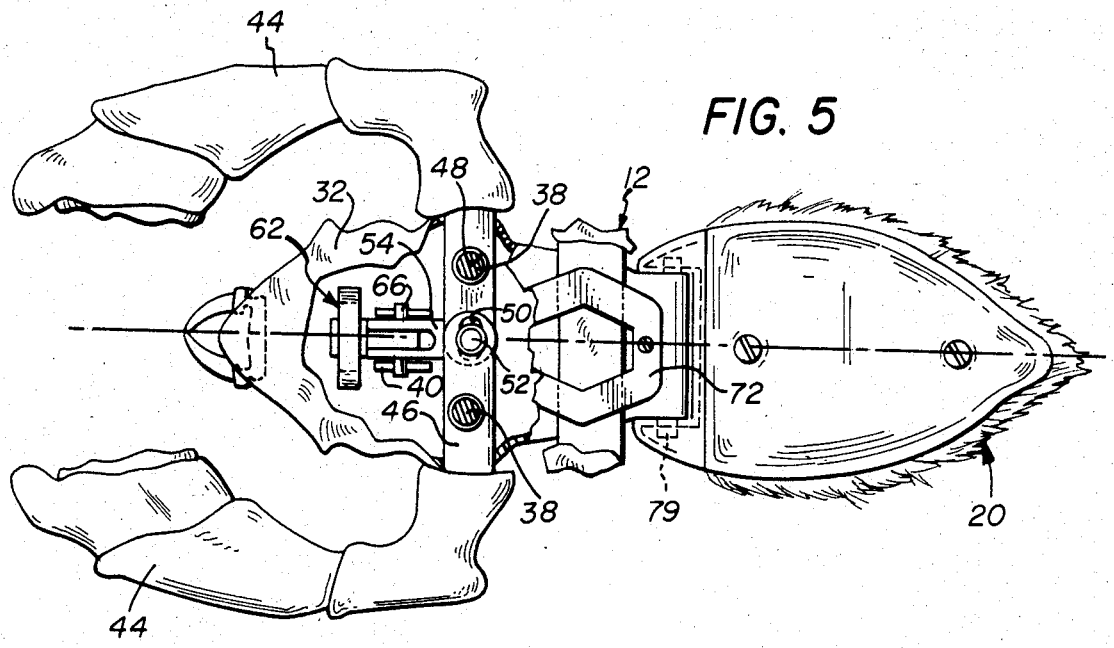
FIG. 5 is a bottom view of the creature assembly with the glove removed and with portions of the housing broken away to illustrate internal strucuture.
Figure 6:
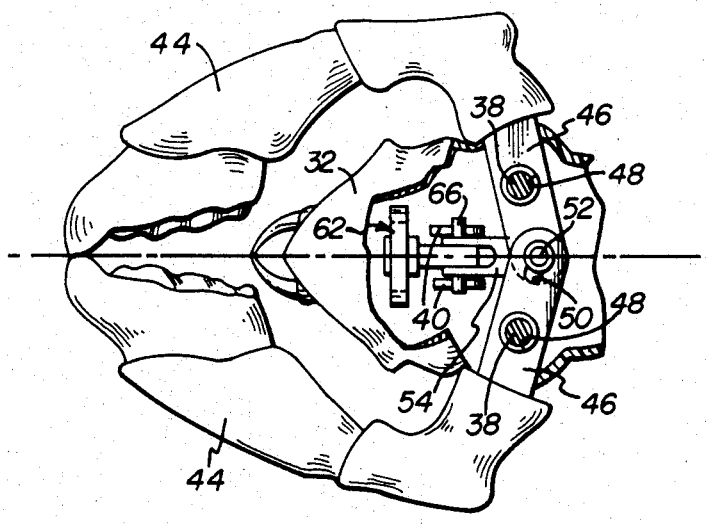
FIG. 6 is a fragmentary bottom view of the front portion of the creature showing the claw members an bell crank assembly in the pivoted position thereof.
Figure 8:
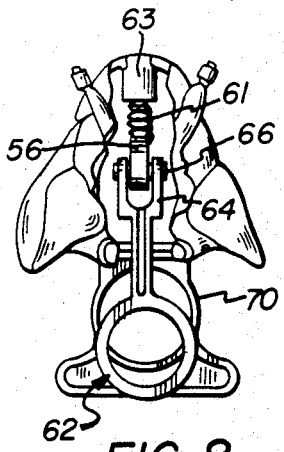
FIG. 8 is a front view of the creature with the glove removed and with portions of the housing broken away and elements omitted for clarity of illustration of the internal construction.

Turning now in detail to the claw members 44, they have generally L-shaped claw arms 44 which are disposed outwardly of the body member 18 which extend forwardly thereof. Lever arms 46 extend into the cavity of the body member 18 and transversely thereof, and their end portions are disposed in overlying relationship. As best seen in FIGS. 5 and 6, the lever arms 46 have pivot apertures 48 therein which receive the pivot posts 38 to provide pivotal mounting of the lever arms to the body member 18. Adjacent their inner ends, the lever arms 46 have aligned pivot slots 50 in which is slidably disposed the pivot bushing 52. As also seen in FIGS. 3 and 4, the pivot bushing 52 is secured to the rearward end of the generally horozontally extending crank arm follower 54 by the threaded fastener 55.

The forward end of the crank arm follower 54 is bifurcated and receives therebetween the lower end of the vertically extending leg of the bell crank 56, and aligned apertures are provided therein through which extends a pivot pin 58. At the juncture between the horizontal and vertical legs of the bell crank 56 is a pivot shaft 60 which seats in recesses formed in the lower end of the crank pivot post 40 and which is trapped in such recesses by the bottom post 42, thus providing the pivotal mounting of the bell crank 56 upon the body member 18. At the upper forward end of the horizontal leg of the bell crank 56 is a hook-shaped portion 59 which seats one end of the tension spring 61. The other end of the spring 61 is attached by a threaded fastener to a depending post 63 formed on the upper wall of the top section 30, and this spring provides biasing action upon the bell crank assembly.

Pivoting of the bell crank 56 is effected by the ring actuator generally designated by the numeral 62 and which has at its upper end a bifurcated portion 64 receiving between its arms the forward end of the horizontal leg of the bell crank 56. A pivot pin 66 extends through aligned apertures therein to provide the pivotal mounting therebetween. The crank ring member extends downwardly in the cavity of the body member 18 and through an aperture in the wall of the bottom section 32 after which it terminates in a ring portion 68.

Figure 2:
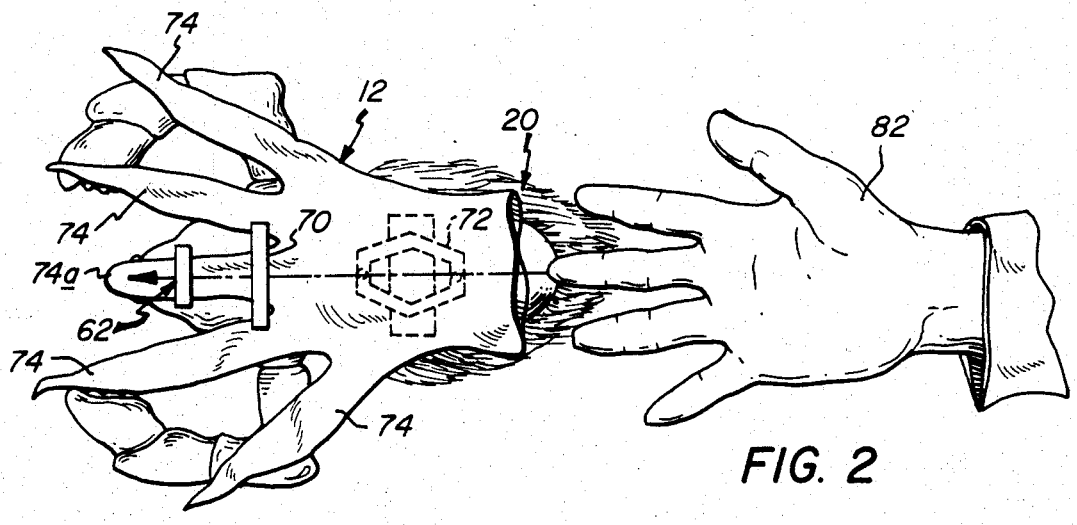
FIG. 2 is a bottom view of the glove puppet assembly of the present invention showing a user's hand prior to insertion into the glove which is attached to the bottom of the body member of the creature figures.

As also seen in FIGS. 2 and 3, there is mounted on the bottom section 32 a depending support ring 70 with the aperture through the ring 70 being substantially aligned with the aperture in the ring portion 68 of the ring actuator 62 in the at rest position of the assembly as seen in FIG. 3.

As seen in FIGS. 2 and 3, the glove 12 is secured to the bottom section 32 of the body member 18 by a glove mounting element 72. The fingers 74 extend forwardly and the wrist portion of the glove extends rearwardly under the tail member 20. The index finger **74*a* of the glove 12 extends through the support ring 70 and through the aperture of the ring portion 68 of the ring actuator 62**.

Turning now to the tail member 20, it can be seen that it is comprised of a top element 76 and a bottom element 78 which are secured together by threaded fasteners seated in posts much in the fashion of the body member 18. Extending about the upper surface and sides of the tail member 20 is a plush cover 80 extends between and which is trapped between the two sections 76,78 upon assembly thereof. The tail section is provided with a forwarded cavity of generally inverted U-shaped cross section in which is received the rearward portion of the body member 18 and pivot pins 79. Pivot projections on the rearward section of the body member 18 are trapped between the mating surfaces of the top and bottom members 76,78 to provide a pivotal connection between the body member 18 and tail member 20 so as to provide articulation therebetween.

In FIGS. 2 and 3, the hand 82 and forearm 84 of the user 82 can be seen. The user's index finger which extends into the index finger portion **74*a* of the glove 12 will thus be disposed in the support ring 70 and in the actuator ring 62 so as to enable a downardly pull on the actuator ring 62 by bending of the index finger. The forearm 84** of the user will be disposed below the tail member 20 so as to enable articulation of the tail member 20 relative to the body member 18 by relative motion between the hand and forearm of the user.

As best seen in FIGS. 1 and 2, the glove 12 is fabricated and dimensioned so as to have the finger portions extend outwardly beyond the ends of the fingers of the user and converge to heighten the simulation of a science fiction creature. Since the glove 12 is fabricated from relatively flexible material, the user may flex the finger portions comprising the four legs of the creature to cause it to appear to walk along a surface and at the appropriate moment cause the jaws to open and close by bending the index finger.

In operation of the device, it will be understood that the downward motion of the crank actuator 62 will cause the bell crank 56 to pivot downwardly about the pivotal mounting 58 and thereby produce a rearward motion of the lower end of its vertical leg. This rearward motion in turn produces a rearward force acting on the crank arm followr 54 which is pivotally connected to the inner ends of the lever arms 46 of the claws 22. Since the claws 22 are also supported in the body member 18 for pivotal motion about fixed pivot points provided by the pivot posts 38, the rearward force of the crank arm follower 54 upon their inner ends produce their pivoting about the pivot posts 38 and causes the outer ends of the claw arms 44 to move inwardly towards each other. Upon release of the downward finger pressure on the ring actuator 62, the spring 61 pulls upwardly on the bell crank 56 to return it to the initial position seen in FIG. 3 which results in the forward movement of the crank arm follower 54 and the inner ends of the lever arms 46, thus returning the claws 44 to the initial or at rest position seen in FIGS. 1, 2 and 6.

In assembling the creature, the antennae 26 are inserted into the head of the top section 30 of the body member 18 and the saddle 16 is secured on its upper surface by the screws illustrated in FIG. 3. The bell crank 56, crank arm follower 54 and actuator ring 62 are asembled as a unit with their respective pivot pins. The claw members 22 are assembled to the crank arm follower 54 with the inner ends of the lever arms 46 placed in overlying relationship with the pivot pin 52 extending therethrough at which point the threaded fastener is inserted to lock the lever arms 46 in assembly to the crank arm follower 54. This assembly is then dropped into position to seat the pivot shaft 60 in the recesses formed in the ends of the crank posts 40, and the claw members 22 are then placed on the top so that the pivot posts 38 extending through the pivot apertures 48 therein.

The tension spring 61 is secured to the spring post 63 by the fasterner and then engaged in the mounting hook 59 of the bell crank 56. At this poing the bottom section 32 is placed over the top section 30 with the ring actuator 62 extending through the aperture therein. Screws 36 are then inserted into the posts 34 to lock the two elements in assembly.

The support ring 70 is then snapped into a seating aperture in the bottom section 32, and the glove 12 is secured to the body member 18 by the glove mounting member 72. The index finger 74*a* of the glove is fed through the support ring 70 and the ring portion 68 of the ring actuator 62.

The tail member 20 is then assembled by forming the plush cover 80 about the top section 76. The top section 76 and the bottom section 78 are then brought together about the pivot pins 79 and secured together to complete the assembly.

It will be readily appreciated that most of the elements of the structure may be readily fabricated by molding synthetic resins of the desired characteristics for the individual components. Thus, the actual configuration of the creature and its appearance may be readily changed by altering the mold cavities in which the top elements are formed to provide the external appearance. Moreover, the several elements may be fabricated from resins which are durable and which provide lubricity where required.

The glove is desirably fabricated from a resiliently expansible material such as that sold under the trademark SPANDEX to simulate a creature's legs. The plush covering may be of any suitable material simulating the furry characteristics desirable for various creatures. These components may then be readily assembled to provide a durable long-lasting structure.

Thus, it can be seen from the foregoing detailed specification and attached drawings that the present invention provides a novel and highly effective simulated creature with a simulated claw-closing play action. The glove assembly allows manipulation of the creature as a glove puppet to walk along a surface and at the same time to effect the simulated closing action of the claws, thus providing a high degree of play action. The components may be readily altered in configuration if so desired to change the appearance of the creature.

Having thus described the invention, what is claimed is:

1. In a simulated creature with movable claws or the like, the combination comprising:

A. a body member having top and bottom elements defining a cavity therewithin;

B. a pair of claw members extending outwardly and forwardly of said body member and having lever portions extending inwardly of said body cavity;

C. a bell crank assembly in said cavity including a bell crank having a generally vertical leg and a generally horizontal, forwardly extending leg at the upper end of said vertical leg, a bell crank follower having its forward end pivotalbly connected to the lower end of said vertical leg of said bell crank for pivotal movement relative thereto about a transverse axis, crank pivot means pivotably mounting the juncture of said legs of said bell crank on said body for pivotal movement relative thereto about an axis extending transversely of said body member, said bell crank follower having its rearward end pivotably connected to the inner ends of said lever portions of said claw members for relative pivotal movement about a vertical axis;

D. lever pivot means pivotably mounting said lever portions on said body at points spaced transversely from said pivotal connection to said bell crank follower for pivotal movement about parallel vertical axes; and E. actuator means having one end extending outwardly of said body and its other end pivotally connected to the forward end of the horizontal leg of said bell crank, whereby movement of said actuator means downwardly will pivot the horizontal leg of said bell crank downwardly about said crank pivot means from a first position to a second position and cause said bell crank follower to drive the inner ends of said lever portions of said claw members rearwardly and thereby cause the claw members to pivot about said lever pivot means to move the outer ends of said claw members towards each other.

2. The creature in accordance with claim 1 wherein said actuator means extends downardly in said cavity and outwardly through and aperture in said bottom element of said body member, said actuator means being adapted to be pulled downwardly manually.

3. The creature in accordance with claim 2 wherein the lower end of said actuator means terminates in a ring portion through which a finger may be inserted to effect the downward movement.

4. The creature in accordance with claim 3 wherein the upper end of said actuator means terminates in a yoke portion receiving the forward end of said horizontal leg therebetween, and a pivot element extends through aligned apertures therein to provide the pivotal connection therebetween.

5. The creature in accordance with claim 1 wherein there is included means biasing said bell crank into its first position.

6. The creature in accordance with claim 5 wherein said biasing means is a spring operating between said bell crank and said body member.

7. The creature in accordance with claim 5 wherein said biasing means is a tension spring having one end attached to the forward end of said horizontal leg of said bell crank and its other end attached to said top element at a point spaced above said bell crank.

8. The creature in accordance with claim 1 wherein the inner end portions of said lever portions and the rearward end of said crank follower are disposed in overlying relationship and a pivot member extends through aligned apertures therein to provide said pivotal connection therebetween.

9. The creature in accordance with claim 1 wherein there is included a glove adapted to receive a user's hand and extending along the lower outer surface of said bottom element and means securing said glove to said bottom element, said actuator means extending downwardly in said cavity and outwardly through an aperture in said bottom element of said body member and having means thereon adapted to be engaged by a user's finger in said glove.

10. The creature in accordance with claim 9 wherein said finger engageable means is a ring portion through which one finger on said glove extends.

11. The creature in accordance with claim 10 wherein there is included a support ring secured to the outer surface of said bottom element rearwardly of said actuator means and through which said one finger of said glove also extends.

12. The creature in accordance with claim 1 wherein there is included a tail member and means pivotally connecting said tail member to the rearward end of said body member for relative pivotal movement about an axis extending transversely of said body member.

13. The creature in accordance with claim 12 wherein there is included a glove adapted to receive a user's hand and extending along the lower outer surface of said bottom element of said body member and the lower surface of said tail member, and means securing the glove the said bottom element of said body member whereby relative movement of the hand and forearm will produce pivoting of said tail and body members relative to each other.

14. In a simulated creature with movable claws or the like, the combination comprising:

A. a body member having top and bottom elements defining a cavity therewithin;

B. a pair of claw members extending outwardly and forwardly of said body member and having lever portions extending inwardly of said body cavity;

C. a bell crank assembly in said cavity including a bell crank having a generally vertical leg and a generally horizontal, forwardly extending leg at the upper end of said vertical leg, a bell crank follower having its forward end pivotably connected to the lower end of said vertical leg of said bell crank for pivotal movement relative thereto about a transverse axis, crank pivot means pivotably mounting the juncture of said legs of said bell crank on said body for pivotal movement relative thereto about an axis extending tranversely of said body member, said bell crank follower having its rearward end pivotably connected to the inner ends of said lever portions of said claw members for relative pivotal movement about a vertical axis;

D. lever pivot means pivotably mounting said lever portions on said body at points spaced transversely from said pivotal connection to said bell crank follower for pivotal movement about parallel vertical axes;

E. actuator means having one end extending outwardly of said body and its other end pivotally connected to the forward end of the horizontal leg of said bell crank, said actuator means extending downwardly in said cavity and outwardly through an aperture in said bottom element of said body member, the lower end of said actuator means terminating in a ring portion in which a finger may be inserted to effect the downward movement thereof; and means biasing said bell crank into its first position, whereby movement of said actuator means downwardly will pivot the horizontal leg of said bell crank downwardly about said crank pivot means from a first position to a second position and cause said bell crank follower to drive the inner ends of said lever portions of said claw members rearwardly and thereby cause them to pivot about said lever pivot means to move the outer ends of said claw members towards each other.

15. The creature in accordance with claim 14 wherein said biasing means is a spring operating between said bell crank and said body member.

16. The creature in accordance with claim 15 wherein said biasing means is a tension spring having one end attached to the forward end of said horizontal leg of said bell crank and its other end attached to said body member at a point spaced above said bell crank.

17. The creature in accordance with claim 16 wherein the inner end portions of said lever portions and the rearward end of said crank follower are disposed in overlying relationship and a pivot member extends through aligned apertures therein to provide said pivotal correction therebetween.

18. In a simulated creature with movable claws or the like, the combination comprising:

A. a body member having top and bottom elements defining a cavity therewithin;

B. a pair of claw members extending outwardly and forwardly of said body member and having lever portions extending inwardly of said body cavity;

C. a bell crank assembly in said cavity including a bell crank having a generally vertical leg and a generally horizontal, forwardly extending leg at the upper end of said vertical leg, a bell crank follower having its forward end pivotably connected to the lower end of said vertical leg of said bell crank for pivotal movement relative thereto about a transverse axis, crank pivot means pivotably mounting the juncture of said legs of said bell crank on said body for pivotal movement relative thereto about an axis extending transversely of said body member, said bell crank follower having its rearward end pivotably connected to the inner ends of said lever portions of said claw members for relative pivotal movement about a vertical axis;

D. lever pivot means pivotably mounting said lever portions on said body at points spaced transversely from said pivotal connection to said bell crank follower for pivotal movement about parallel vertical axes;

E. actuator means having one end extending outwardly of said body and its other end pivotally connected to the forward end of the horizontal leg of said bell crank, whereby movement of said actuator means downwardly will pivot the horizontal leg of said bell crank downwardly about said crank pivot means from a first position to a second position an cause said bell crank follower to drive the inner ends of said lever portions of said claw members rearwardly and thereby cause the claw members to pivot about said lever pivot means to move the outer ends of said claw members towards each other;

F. a glove adapted to receive a user's hand and extending along the lower outer surface of said bottom element;

G. means securing said glove to said bottom element, said actuator means extending downwardly in said cavity and outwardly through an aperture in said bottom element of said body member and having means thereon adapted to be engaged by a user's finger in said glove; p1 H. a tail member; and I. means pivotally connecting said tail member to the rearward end of said body member for relative pivotal movement about an axis extending transversely of said body member.

19. The creature in accordance with claim 18 wherein said finger engageable means is a ring portion through which one finger on said glove extends and wherein there is included a support ring secured to the outer surface of said bottom element rearwardly of said actuator means and through which said one finger of said glove also extends.

20. The creature in accordance with claim 19 wherein there is included biasing means in said cavity biasing said bell crank into its first portion.

* * * * *